United States Patent [19]

Merten et al.

[11] Patent Number: 4,458,951

[45] Date of Patent: Jul. 10, 1984

[54] APPARATUS FOR CONTROLLING THE POSITION OF A MINERAL MINING MACHINE

[75] Inventors: Gerhard Merten; Bernd Steinkuhl, both of Lünen; Oswald Breuer, Dortmund; Horst Schlüsener, Werne, all of Fed. Rep. of Germany

[73] Assignee: Gewerkschaft Eisenhutte Westfalia, Lunen, Fed. Rep. of Germany

[21] Appl. No.: 434,633

[22] Filed: Oct. 15, 1982

[30] Foreign Application Priority Data

Oct. 21, 1981 [DE] Fed. Rep. of Germany ..... 3141695

[51] Int. Cl.[3] ..... E21C 27/32

[52] U.S. Cl. ..... 299/43; 299/34

[58] Field of Search ..... 299/43, 34, 32

[56] References Cited

U.S. PATENT DOCUMENTS

| | | | |
|---|---|---|---|
| 3,847,438 | 11/1974 | Huttenbrauck et al. | 299/34 |
| 4,045,089 | 8/1977 | Hauschopp et al. | 299/43 |
| 4,186,969 | 2/1980 | Beckmann | 299/43 |
| 4,200,338 | 4/1980 | Beckmann | 299/43 |
| 4,280,734 | 7/1981 | Blumenthal et al. | 299/43 X |

FOREIGN PATENT DOCUMENTS

| | | | |
|---|---|---|---|
| 6603634 | 12/1967 | Fed. Rep. of Germany . | |
| 2319910 | 10/1974 | Fed. Rep. of Germany . | |
| 2534325 | 2/1977 | Fed. Rep. of Germany . | |
| 2942089 | 4/1981 | Fed. Rep. of Germany . | |
| 2060737 | 5/1981 | United Kingdom | 299/34 |
| 2062069 | 5/1981 | United Kingdom | 299/43 |

*Primary Examiner*—James A. Leppink
*Assistant Examiner*—Beverly E. Hjorth
*Attorney, Agent, or Firm*—Thompson, Birch, Gauthier & Samuels

[57] ABSTRACT

Apparatus for controlling the position of a mineral winning machine, such as a plough, movable along a guide at the mineral face side of a scraper-chain conveyor employs a connector bracket at the goaf side of the conveyor to which a floor-engaging skid plate is pivotably linked. A beam extends from a roof support and is also pivotably connected to the skid plate remote from the conveyor. A pair of piston and cylinder units are pivotably connected at their upper ends to the bracket. One of the units is pivotably connected to the skid plate and the other is pivotably connected to the beam. By operating the units together the skid plate can be held against the floor over part or all of its lower face while the conveyor goaf side is raised or lowered accordingly.

6 Claims, 3 Drawing Figures

APPARATUS FOR CONTROLLING THE POSITION OF A MINERAL MINING MACHINE

BACKGROUND OF THE INVENTION

The present invention relates in general to mineral mining installations and, more particularly, to apparatus for controlling the position of a mineral mining or winning machine movable along guide means.

For this purpose, it is know to use a form of control apparatus with hydraulic piston and cylinder units connected between the guide means, more particularly a conveyor having a guide on its mineral face side, and elongate beams pivotably in relation to the conveyor and displaceably guided on roof supports. Examples of known apparatuses are described in U.S. Pat. Nos. 4,045,089 and 4,186,969 in German patent specification Nos. 2319910, 2535325 and 2942089 and in German Gebrauchsmuster No. 6603643.

Various problems are encountered with know apparatuses, For example, it is not always possible to control the machine properly especially when the conveyor is tilted to cause the machine to climb. Also when the goaf side of the conveyor is raised from the floor fire material, such as coal dust, can pass beneath the raised conveyor and find its way into the roof support zone. Such material can adversely affect the operation of the roof supports and also represents a loss of material. A general object of the present invention is to provide an improved form of control apparatus.

SUMMARY OF THE INVENTION

Apparatus constructed in accordance with the invention may comprise connection means formed on guide means along which a mining machine is movable, a piston and cylinder unit pivotably connected to the connection means and a beam pivotably connected to the connection means and guided for displacement on a roof support. In accordance with the invention, the connection means comprises a bracket pivotably linked to an intermediate floor-engaging skid or plate, the beam is pivotably connected to the skid and a further piston and cylinder unit is pivotably connected to the bracket and to the beam. The guide means can take the form of a scraper chain conveyor having a guide on its mineral face side. The piston and cylinder units may be connected at their upper ends to the bracket via a common pivot joint. These units can also be connected in common to the associated hydraulic system to extend or retract in unison.

With an arrangement in accordance with the invention enhanced control of the piston of the machine is possible. The skid is maintained in contact with the floor of the working, at least partly, at all times. In a typical installation a plurality of brackets, floor skids and piston and cylinder units would be provided and distributed along the working at the locations of the roof supports. The skids can then form barriers to inhibit the passage of fine material beneath the conveyor. The beams can also be pressed against the floor by the units.

The present invention also provides apparatus for controlling the position of a mineral mining machine movable along a guide on a conveyor; said apparatus including a floor-engageable plate pivotably connected to the conveyor, a generally upstanding piston and cylinder unit pivotably connected with the conveyor and pivotably connected to the plate, a beam guidable on a roof support and pivotably connected to the plate and a further inclined piston and cylinder unit pivotably connected with the conveyor and pivotably connected to the beam.

In another aspect the invention provides apparatus for controlling the position of a mineral winning machine guided for movement along a guide on a scraper-chain conveyor; said apparatus comprising brackets fitted to the goaf side of the conveyor, skid plates engageable with the floor of the mine working and pivotably connected to lower parts of the brackets, piston and cylinder units linked with pivot joints at their upper ends to the brackets and linked with pivot joints at their lower ends to the skid plates, beams guidable on roof supports and pivotably connected to the skid plates and further piston and cylinder units linked with pivot joints at their upper ends to the brackets and linked with pivot joints at their lower ends to the beams, the units and further units being operable to adjust the position of the conveyor with the skid plates maintained in contact with the floor of the working and forming individual barriers inhibiting the passage of fine material when the goaf side of the conveyor is raised.

BRIEF DESCRIPTION OF THE DRAWINGS

An embodiment of the invention will now be described, by way of example only, with reference to the accompanying drawings, wherein.

DESCRIPTION OF PREFERRED EMBODIMENT

Figure 1:
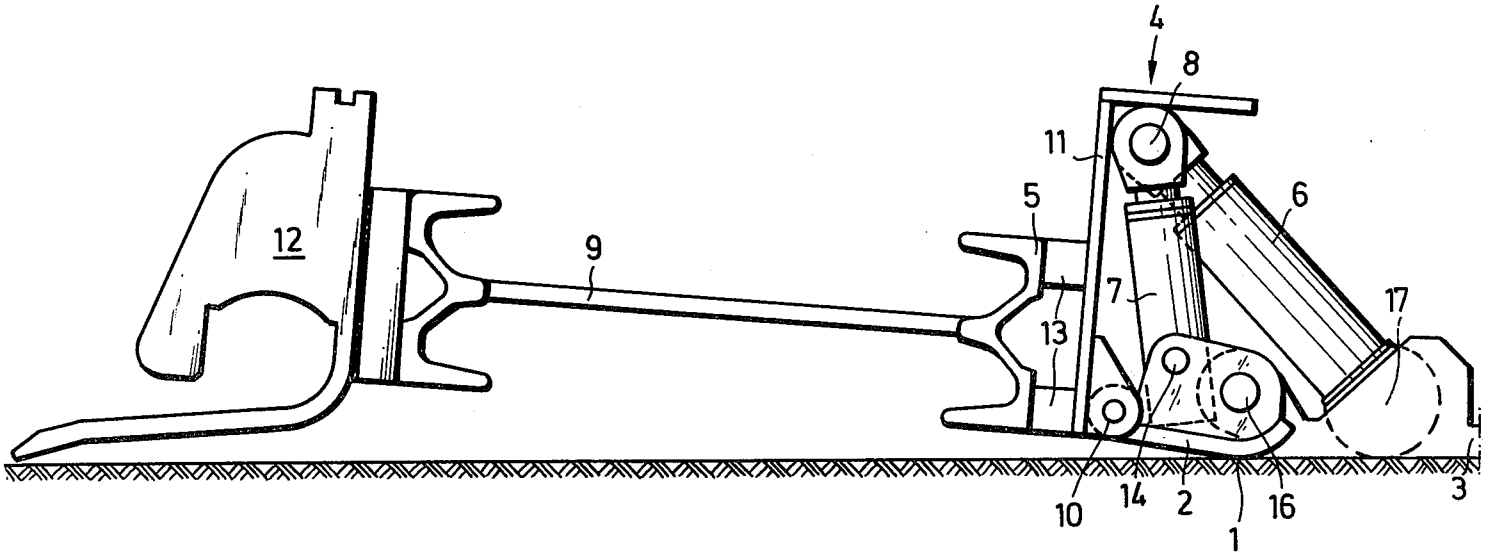
FIG. 1 is a schematic side view of part of a mineral mining installation employing apparatus constructed in accordance with the invention.
Figure 2:
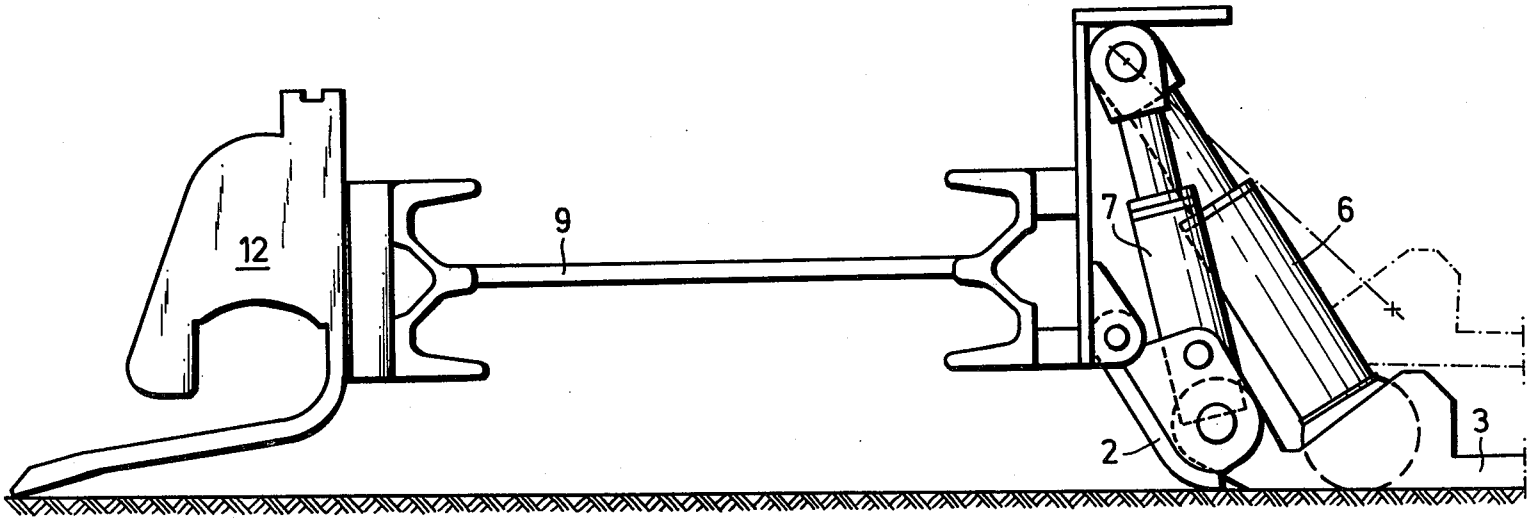
FIGS. 2 and 3 are views of the installation shown in FIG. 1 depicting the apparatus in a different operating positions.
Figure 3:
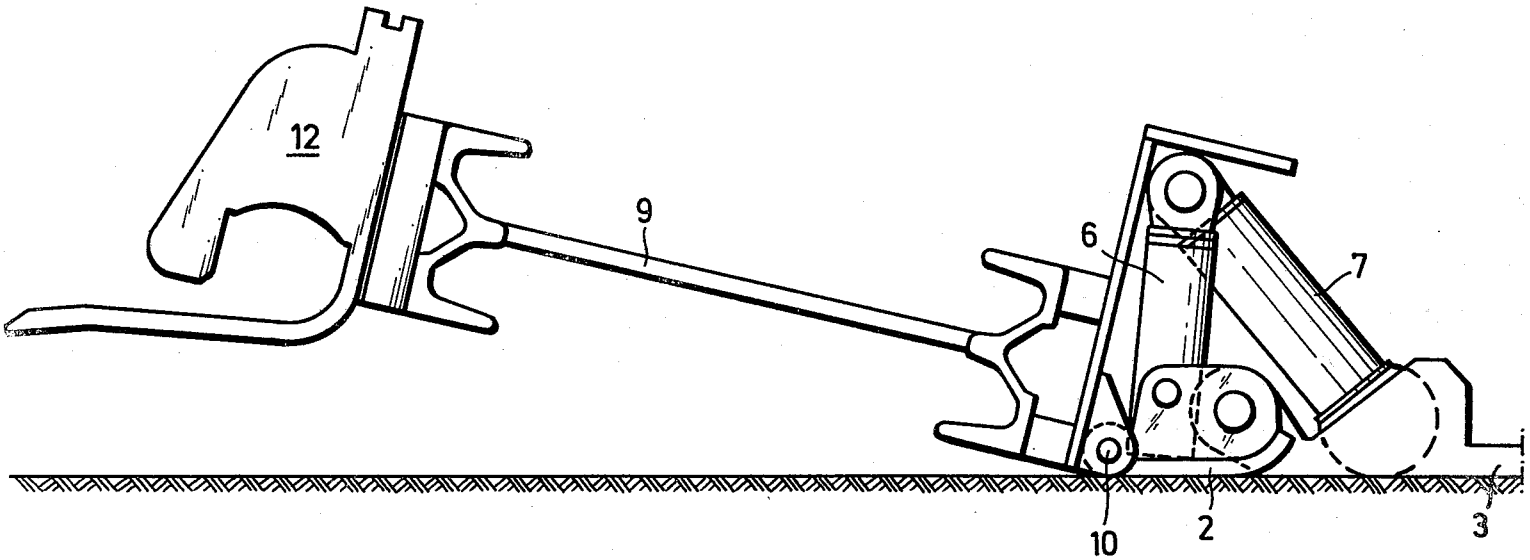

As represented in FIGS. 1 to 3, a conveyor 9 of a mineral mining installation is in the form of a scraper-chain conveyor constructed from individual pans or channel sections arranged end-to-end and interconnected for limited mutual displacement. A scraper-chain assembly is driven along the pans. As is known, the conveyor 9 extends alongside a mineral, e.g. coal face and is advanced towards the face in sections in a snaking movement to follow the mineral winning progress. A guide 12 not shown in detail, is provided on the mineral face side of the conveyor 9. The guide 12 serves to guide a winning machine, such as a plough, which is moved along the guide 12.

Roof supports (not shown) would be arranged along the working and spaced from the goaf side of the conveyor 9 remote from the mineral face. The goaf side wall 5 of the conveyor 9 is reinforced with the aid of bars 13 and brackets 4 are fitted to the goaf side wall 5 to provide connections for apparatus constructed in accordance with the invention.

Each bracket 4 is of inverted L-shape with an upstanding wall 11 fitted to the side wall 5 of the conveyor 9 and an upper wall projecting outwardly from the conveyor 9. A foot or skid plate 2 is pivotably coupled to the lower portion of the wall 11 with the aid of a coupling 10. An upstanding hydraulic piston and cylinder unit 7 is connected between the bracket 4 and the plate 2. As illustrated the cylinder of the unit 7 is connected to the plate 2 with a pivot joint 14 while the piston rod of the unit 7 is connected to the bracket 4 with a pivot joint 8. The plate 2 has a curvilinear outer end portion. Part or all of the lower face of the skid 2 engages on the floor of the working at all times. A beam 3 is associated with one of the roof supports in known manner. Normally the beam 3 would be mounted and guided on the roof support so that longitudinal motion and same angular mobility is permitted while vertical displacement is restricted. The beam 3 is connected to the plate 2 via a pivot joint 16. A further inclined piston and cylinder unit 6 is connected between the bracket 4 and the beam 3. As illustrated, the cylinder of the unit 6 is connected to the beam 3 with the aid of a ball-and-socket joint 17 spaced outwardly from the pivot joint 16. The piston rod of the unit 6 is pivotably connected to the bracket 4 conveniently with the same pivot joint 8 as the unit 7.

The units 6,7 are connected in common to a hydraulic circuit and operate to adjust the angular position of the conveyor 9 and the machine guide 12 relative to the beam 3. The operation of the apparatus can best be appreciated by comparing FIGS. 1 to 3. Assume that FIG. 1 depicts the normal operating position and it is desired to control the machine moving along the guide 12 so that it 'dips' and cuts lower down. In this case the units 6,7 are extended by the admission of pressure fluid and the conveyor 9 is raised at the goaf side as shown in FIG. 2. The plate 2, although inclined, remains in contact with the floor, The plates 2 along the working adopt similar positions and present a barrier to fine coal dust. The beams 3 also remain close or in contact with the floor and the access space is thus not restricted. If it is desired to control the machine so that it 'claims' and cuts higher the units 6,7 are retracted by the removal of pressure fluid and the conveyor 9 is lowered at the goaf side as shown in FIG. 3. The lower face of the plate 2 now lies in full face-to-face contact with the floor.

We claim:

1. Apparatus for controlling the position of a mineral winning machine guided for movement along a guide on a scraper-chain conveyor; said apparatus comprising brackets fitted to the goaf side of the conveyor, skids engageable with the floor of the mine working and pivotably connected to lower parts of the brackets, first piston and cylinder units linked with pivot joints at their upper ends to the brackets and linked with pivot joints at their lower ends to the skids, beams of the type guidable on roof supports pivotably connected to the skids, and second piston and cylinder units linked with pivot joints at their upper ends to the brackets and linked with pivot joints at their lower ends to the beams, the first and second piston and cylinder units being operable in unison to adjust the position of the conveyor with the skids maintained in contact with the floor of the working and forming individual barriers inhibiting the passage of fine material when the goaf side of the conveyor is raised.

2. In an apparatus for controlling the position of a mineral mining machine movable along guide means; said apparatus comprising bracket means on the guide means, a floor-engaging skid pivotably connected to the guide means, and a first generally upstanding piston and cylinder unit pivotably connected to the bracket means and to the skid and operable to effect relative pivotal movement between the guide means and the skid; the improvement comprising an end of an elongate beam is pivotably connected to the skid outwardly from the guide means and a second piston and cylinder unit is pivotably connected to the end of the beam and to the bracket means, the piston and cylinder units being operated in unison to adjust the guide means over a range of angular positions.

3. Apparatus according to claim 2, wherein the guide means is a conveyor with a machine guide on one side and the bracket means on the opposite side.

4. Apparatus according to claim 3, wherein the bracket means is of inverted L-shape, the piston and cylinder units being pivotably connected to an upper region of the bracket means and the skid being pivotably connected to a lower region of the bracket means.

5. Apparatus according to claim 2, wherein both the piston and cylinder units are pivotably connected to the bracket means via a common pivot connection.

6. Apparatus according to claim 2, wherein the second piston and cylinder unit is pivotably connected to the end of the beam by way of a ball-and-socket joint.

* * * * *